US006900770B2

(12) United States Patent
Apostolos

(10) Patent No.: US 6,900,770 B2
(45) Date of Patent: May 31, 2005

(54) COMBINED ULTRA WIDEBAND VIVALDI NOTCH/MEANDER LINE LOADED ANTENNA

(75) Inventor: John T. Apostolos, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/629,454

(22) Filed: Jul. 29, 2003

(65) Prior Publication Data

US 2005/0024281 A1 Feb. 3, 2005

(51) Int. Cl.[7] ..... H01Q 21/00
(52) U.S. Cl. ..... 343/725; 343/767
(58) Field of Search ..... 343/725, 767, 343/770

(56) References Cited

U.S. PATENT DOCUMENTS

| | | | | |
|---|---|---|---|---|
| 4,853,704 A | | 8/1989 | Diaz et al. | |
| 5,227,808 A | * | 7/1993 | Davis | 343/915 |
| 5,268,701 A | * | 12/1993 | Smith | 343/767 |
| 5,519,408 A | * | 5/1996 | Schnetzer | 343/767 |
| 5,786,792 A | * | 7/1998 | Bellus et al. | 343/770 |
| 5,790,080 A | | 8/1998 | Apostolos | |
| 6,323,814 B1 | | 5/2001 | Apostolos | |
| 6,373,440 B2 | | 5/2001 | Apostolos | |
| 6,373,446 B2 | | 5/2001 | Apostolos | |
| 6,480,158 B2 | | 5/2001 | Apostolos | |
| 6,492,953 B2 | | 5/2001 | Apostolos | |
| 6,404,391 B1 | | 7/2001 | Apostolos | |
| 6,313,716 B1 | | 11/2001 | Apostolos | |
| 6,597,321 B2 | * | 7/2003 | Thursby et al. | 343/744 |
| 6,630,909 B2 | * | 10/2003 | Nepveu | 343/744 |

OTHER PUBLICATIONS

P.G. Gibson of Phillips Research Laboratories, Redhill, Surrey, England, Monograph: "The Vivaldi Aerial," 1978.

Ramakrishna Janaswamy and Daniel H. Schaubert, "The Vivaldi Aerial," IEEE Transactions on Antennas and Propagation, vol. AP–35, No. 1, Sep., 1987.

* cited by examiner

*Primary Examiner*—Tho Phan
(74) *Attorney, Agent, or Firm*—Daniel J. Long; Robert K. Tendler

(57) ABSTRACT

The combination of a Vivaldi slot and a meander line loaded antenna is provided which exhibits an ultra wideband characteristic with the Vivaldi notch expanding the high end and with the meander line loaded antenna portion reducing the low frequency cut-off. When these antennas are arrayed, this array exhibits a single lobe and an ultra wide 100:1 bandwidth. The Vivaldi notch portion of the antenna accommodates the higher frequencies, whereas the meander line loaded antenna portion of the antenna accommodates the lower frequencies, there being a smooth transition region between the Vivaldi and meander line portions of the antenna and no discontinuity. In one embodiment, the antenna is made to work between 50 MHz and 1500 MHz with a VSWR less than 3:1. The Vivaldi notch meander line combination assures that for an array one does not have a separation of the elements more than a 0.5 wavelength at the highest frequency, thus to eliminate the possibility of creating grating lobes. As one goes down in frequency to 1/50 of the highest frequency, the 0.5 wavelength is divided by 50. This means that antenna element spacing is 0.01 wavelength at the low frequency end, clearly below that separation which would cause grating lobes. In short, the generation of grating lobes at the high end is prevented because the antenna element spacing is less than a 0.5 wavelength, with the situation improving as one goes down in frequency.

9 Claims, 3 Drawing Sheets

VSWR of the combined vivaldi / mia ultra wideband antenna

COMBINED ULTRA WIDEBAND VIVALDI NOTCH/MEANDER LINE LOADED ANTENNA

FIELD OF INVENTION

This invention relates to ultra wideband antennas, and more particularly to the utilization of a combined Vivaldi notch and meander line loaded antenna.

BACKGROUND OF THE INVENTION

There has long been a requirement for a very wide band array antenna to cover, for instance, a band of 100:1 or even 300:1. The purpose of such an antenna is for any ultra wideband application in which one seeks to have a single lobe from the antenna array uncorrupted by so called grating lobes which are the spurious lobes which are the result of standing waves in the elements and element spacings greater than 0.5 wavelength.

An array of bow tie elements suffers from grating lobes introduced by the many periods of oscillation in the element itself, and by the resulting large spacing of the elements.

In order to eliminate the generation of multiple lobes, one would need some sort of traveling wave antenna with a width less than 0.5 wavelength at the highest frequency.

One such traveling wave antenna is a Vivaldi notch antenna. The Vivaldi notch antennas are those which have exponentially tapered notches which open outwardly from a feed at the throat of the notch. Typically, in such a Vivaldi notch antenna there is a cavity behind the feed point which prevents energy from flowing back away from the feed point to the back end of the Vivaldi notch. As a result, in these antennas, one obtains radiation in the forward direction, and obtains a single lobe beam over a 10:1 frequency range. One can obtain a VSWR less than 3:1 with the beams staying fairly constant at about 80° or 90° beam widths.

As can be seen, the Vivaldi notch antennas are single lobe antennas which have a very wide bandwidth and are unidirectional in that the beam remains relatively constant as a single lobe over a 10:1 bandwidth both in elevation and in azimuth.

Note that a constant beam width is maintained because at high frequencies at the throat of the notch only a small area radiates. As one goes lower and lower in frequency, the wider parts of the notch are responsible for the radiating. As a result, the beam width tends to remain constant and presents itself as a single lobe.

The Vivaldi notch antennas were first described in a monograph entitled The Vivaldi Aerial by P. G. Gibson of the Phillips Research Laboratories, Redhill, Surrey, England in 1978 and by Ramakrishna Janaswamy and Daniel H. Schaubert in IEEE Transactions on Antennas and Propagation, vol. AP-35, no. 1, September 1987. The above article describes the Vivaldi aerial as a new member of the class of aperiodic continuously scaled antenna structures which has a theoretically unlimited instantaneous frequency bandwidth. This antenna was said to have significant gain and linear polarization that can be made to conform to constant gain versus frequency performance. One reported Gibson design had been made with approximately 10 dB gain and a minus −20 dB side lobe level over an instantaneous frequency bandwidth extending from below 2 GHz to about 40 GHz.

One Vivaldi notch antenna is described in U.S. Pat. No. 4,853,704 issued Aug. 1, 1989 to Leopold J. Diaz, Daniel B. McKenna, and Todd A. Pett. The Vivaldi notch has been utilized in micro strip antennas for some time and is utilized primarily in the high end of the electromagnetic spectrum as a wide bandwidth antenna element.

The problem with Vivaldi notch antennas is that at low frequencies, the notch becomes a short circuit. If one attempts to feed a short circuit at low frequencies, one obtains no output.

There is therefore a necessity for providing an array antenna element which has the favorable characteristics of the Vivaldi notch antennas, yet is able to me made to operate at much lower frequencies.

The problem, however, with making these antennas operate at much lower frequencies, is that as one goes lower in frequency, the antenna elements themselves become larger. When one attempts to array these elements, since the array elements are larger, their separation often exceeds a 0.5 wavelength. Separations over a 0.5 wavelength result in unwanted multiple lobes called grating lobes.

It has been found that if one wants to avoid grating lobes, then the spacing between the antenna elements must be less than a 0.5 wavelength. It is therefore important to be able to fabricate an antenna with exceedingly small antenna elements so as to avoid the unwanted grating lobes while offering wideband performance.

SUMMARY OF THE INVENTION

In order to obtain an ultra wideband antenna element for use in an array, in the subject invention, the Vivaldi notch antenna is combined with a meander line loaded antenna structure, such that for the higher frequencies, the Vivaldi notch dominates, whereas for the lower frequencies, the meander line loaded antenna functioning as a dipole provides a wide bandwidth low end for the antenna element. Because the meander line loaded structure reduces element size, this combination can be arrayed without producing grating lobes.

In order to form the dipole necessary for the meander line loaded antenna, the Vivaldi notch antenna rather than being provided with a closed end cavity, is provided with the end cavity opened up with a rearward slot so that at the lower frequency range, the antenna element starts to look like a dipole. Since the feed point is no longer shorted out at the lower frequencies, the result is that one has a fairly fat dipole. The problem with such an arrangement is how to make the dipole work over a 10:1 frequency range of its own accord.

In order to do so, one utilizes the meander line loaded antenna structure to make the dipole work over a wide bandwidth by canceling out reactances at the low end of the frequency range. Such operation is described in U.S. patent application Ser. No. 10/123,787 filed Apr. 16, 2002 by John T. Apostolos entitled "Method and Apparatus for Reducing the Low Frequency Cut-off of a Meander Line Loaded Antenna", assigned to the assignee hereof and incorporated herein by reference.

In one embodiment, the antenna is provided with a Vivaldi notch in an upper plate which is bifurcated down its length. Two side plates vertically depending downwardly from respective top plates and are spaced from the top plates at either edge. The side plates are coupled to the top plate through a meander line structure, the purpose of which is to cancel reactances. The result is an overall ultra wideband structure that is small. When this structure is arrayed, the resulting structure does not violate the restriction that the spacing between the elements not be greater than a 0.5 wavelength at the highest frequency. This means that the arrayed antenna elements will exhibit no grating lobes across the entire ultra wideband range, and results in an ultra wideband single lobe antenna array.

It has been found that by combining the two technologies, namely the Vivaldi notch antenna and the meander line technology, that at the high frequency the Vivaldi notch is the active radiator, which doesn't see the meander line at all. At the higher frequencies, the gap on the top plate is not seen, and the Vivaldi notch works as it would work normally at the higher frequencies.

As the operating frequency gets lower and lower, the dipole begins to come into play, and the Vivaldi notch becomes less prominent. There is a transition region in which the notch and the dipole are now equally radiating. However, as one goes lower in frequency, the notch is not seen, and one simply is left with the dipole augmented with the meander line structure.

The meander line structure is utilized to give the dipole the increased bandwidth by canceling out the reactances at the low end of the frequency band. This gives an exceptionally good match down to the very low frequencies.

As part of this invention, it has been found that the transition region between the Vivaldi notch and the meander line loaded antenna is smooth, and that there is no discontinuity. The result is that one can provide that the antenna work over a 50:1 frequency range.

When one seeks to put these elements in an array, the separation of the elements is not more than a 0.5 wavelength at the highest frequency, thus eliminating the possibility of creating grating lobes. If the spacing were for instance to become more on the order of a wavelength, one would obtain the undesirable multi-lobe pattern.

It has been found that the subject antenna when arrayed can work over a range of 50 MHz and 1500 MHz. Note that the spacing of the elements is less than a 0.5 wavelength at the highest frequency. As one goes down to $1/50^{th}$ of the highest frequency, then the 0.5 wavelength divided by 50 is 0.01 wavelengths at the low end of the frequency spectrum for the element. Thus for low frequencies, the spacing requirement is overly met, whereas at the highest frequencies the spacing requirement is just met.

It will be appreciated that for an effective radiator, it is the volume of the structure which counts. Even though the element at the lowest frequency is very narrow, one nonetheless obtains volume in the longitudinal direction or axis of the antenna element.

When the antenna elements are arrayed, one also obtains height and depth so that the total volume is such that it is still efficient at the low end of the frequency spectrum, even though its lateral dimension is 0.01 wavelengths in width.

It will be appreciated that that the utilization of the Vivaldi notch along with the meander line loaded antenna configuration means that the elements are so small in the width direction that when the elements are arrayed, grating lobes are prevented from being generated.

If one were going to use some other technology in order to work over a frequency range of 100:1, one could presumably use bow tie structures. However, at the lowest frequency of operation of a bow tie, one would have at least $1/10^{th}$ of a wavelength which means that if one wanted to go up to 100:1 in frequency, then the structure at the high frequency would be 10 wavelengths long, resulting in a severe multi-lobe pattern.

It has been found that the only other antenna element that could work is the meander line itself, but the meander line itself only works over a frequency range of approximately 5–7:1. It does not achieve the 100:1 frequency range that is required. Absent combining with a Vivaldi notch nearly using meander line structures will not yield an ultra wideband result.

Providing a single lobe ultra wideband antenna is useful in ultra wideband authorization for wireless as well as other applications. In these applications, one does not want to have spurious side lobes or multiple lobes. Ultra wideband applications such as for instance covert communications, high data rate communications, burst communications, through-the-wall communications, ground-penetrating radar, and others, involve the sweeping of a frequency of, for instance, between 1.5 GHz and 100 GHz.

Using the subject invention, one is now able with the combined Vivaldi notch and meander line structure to achieve an ultra wideband result. When arrayed, these antenna elements can be made to have a single lobe characteristic. One can therefore provide an antenna array whose elements are compact and whose spacing between the elements is less than a 0.5 wavelength.

In summary, the combination of a Vivaldi slot and a meander line loaded antenna is provided which exhibits an ultra wideband characteristic with the Vivaldi notch expanding the high end and with the meander line loaded antenna portion reducing the low frequency cut-off. When these antennas are arrayed, this array exhibits a single lobe and an ultra wide 100:1 bandwidth. The Vivaldi notch portion of the antenna accommodates the higher frequencies, whereas the meander line loaded antenna portion of the antenna accommodates the lower frequencies, there being a smooth transition region between the Vivaldi and meander line portions of the antenna and no discontinuity. In one embodiment, the antenna is made to work between 50 MHz and 1500 MHz with a VSWR less than 3:1. The Vivaldi notch meander line combination assures that for an array one does not have a separation of the elements more than a 0.5 wavelength at the highest frequency, thus to eliminate the possibility of creating grating lobes. As one goes down in frequency to 1/50 of the highest frequency, the 0.5 wavelength is divided by 50. This means that antenna element spacing is 0.01 wavelength at the low frequency end, clearly below that separation which would cause grating lobes. In short, the generation of grating lobes at the high end is prevented because the antenna element spacing is less than a 0.5 wavelength, with the situation improving as one goes down in frequency.

BRIEF DESCRIPTION OF THE DRAWINGS

These and other features of the subject invention will be better understood in connection with the Detailed Description in conjunction with the Drawings, of which.

4, illustrating dual Vivaldi notches with the feed point being at the closest approximation of the Vivaldi notches, thus to provide a combined Vivaldi notch and meander line loaded antenna configuration which is bi-directional.

DETAILED DESCRIPTION

Figure 1:
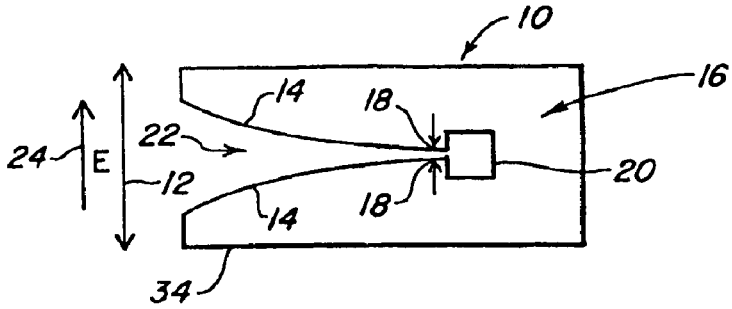
FIG. 1 is a top view of a Vivaldi notch antenna illustrating the feed point at the throat of the notch and a cavity to make the antenna unidirectional.

Referring to FIG. 1, a Vivaldi notch waveguide antenna 10 is illustrated as having an aperture 12 which is formed by exponentially shaped edges 14 in a plate 16. The antenna has a pair of feed points 18 which are adjacent the region of closest approximation of edges 14. Behind the feed point is a cavity 20, the purpose of which is to reflect back any rearwardly projecting radiation out through the notch which is defined by edges 14. The notch is therefore established by these edges as notch 22. Note that the E-field for the Vivaldi notch antenna Figure is as illustrated by arrow 24.

As mentioned hereinbefore, it is a feature of the Vivaldi notch antenna that its upper frequency cut-off is virtually unlimited. Thus it is typical for the Vivaldi notch antennas to operate from for instance from 100 MHz up to 10–20 GHz.

While this wide bandwidth operation is desirable, in some instance, the low frequency cut-off of such a Vivaldi notch antenna is restricted due to the fact that as one descends lower and lower in frequency, the feed is looking into a dead short. The result is no effective radiated energy below 100 MHz.

Figure 2:
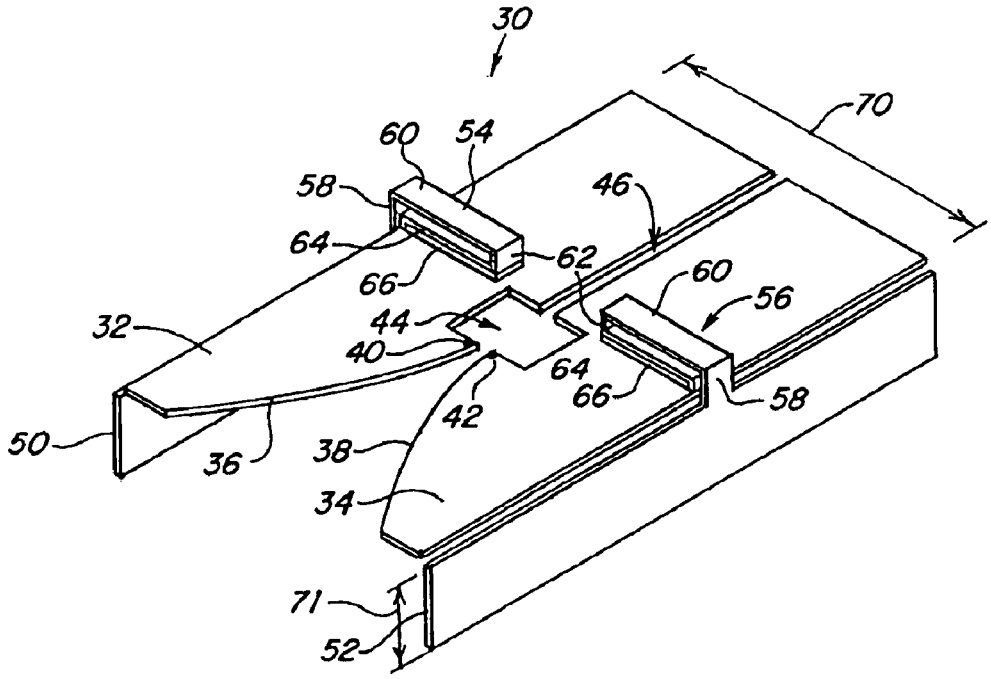
FIG. 2 is a diagrammatic representation of the subject combined Vivaldi notch, meander line loaded antenna configuration, illustrating that the width of the antenna is minimized due to the meander line loaded antenna portion thereof.

As part of the subject invention, and in an effort to decrease the low frequency cut-off of the antenna FIG. 1, referring now to FIG. 2, a combined Vivaldi notch/meander line loaded antenna structure 30 is illustrated as having bifurcated top plates 32 and 34, with the top plates having exponentially shaped edges respectively at 36 and 38. The feed points 40 and 42 are at the points of closest approximation of edges 36 and 38, with a cavity 44 formed behind the feed points.

In an effort to lower the low frequency cut-off of the Vivaldi notch antenna, the top plate is bifurcated as illustrated so as to leave a slot 46 between the plates aft of cavity 44. What this does is to provide the opportunity for forming a dipole antenna having a low frequency cut-off much lower than that associated with the Vivaldi notch portion of the antenna.

In order to complete the meander line loaded proportion of the antenna, downwardly depending side plates 50 and 52 are coupled to associated top plates 32 and 34 through meander lines 54 and 56 respectively. Each of the meander lines has an upstanding portion 58, a laterally projecting portion 60, a downwardly depending portion 62, and a folded back portion 64 attached at its distal end to an edge of plate 34, with the folded back portion being electrically insulated from the respective plate by an insulating layer 66. Note that in one embodiment for a 50 MHz to 1500 MHz antenna the width 70 of the combination is 4 inches and the width 71 of the side plates is 4 inches.

It is the purpose of the meander line loaded structure to reduce the overall physical size of the dipole section of this antenna while at the same time decreasing the low frequency cut-off of this section by effectively canceling the reactance. Thus, as the operating frequency of the antenna decreases, the reactance cancellation results in a VSWR of less than 3:1 down to, for instance in one embodiment, 50 MHz, and in some instances, down to 30 MHz.

It is the finding of the subject invention that the operation of the Vivaldi notch is not affected by the dipole portion of the antenna and as such the top or high frequency cut-off is unaltered by the meander line structure. On the other hand, it has been found that low frequency cut-off of the combined structure is that associated with the meander line loaded antenna portion.

Additionally, it has been found that the transition between low frequency and high frequency is smooth, and that there are no discontinuities in operation as one goes from a lower frequency to a higher frequency.

At the higher frequencies, it is the Vivaldi notch portion of the antenna which is active, whereas at the lower frequencies, it is the meander line loaded antenna dipole which is active.

Moreover, the width of the antenna as illustrated by double ended arrow 70 is indeed minimized by virtue of the meander line loaded antenna structure, it being noted that the meander line loaded structure is in general utilized to provide miniaturization for antennas by reducing the overall size of the antennas involved.

In terms of the antenna pattern from the antenna of FIG. 2, it is desirable to have a single lobe uncorrupted by multiple lobes when the antennas are arrayed. As mentioned hereinbefore, it is important that at the highest frequency of operation, the width 70 be no greater than 0.5 wavelengths. The width reduction due to the meander line loading antenna portion satisfies this requirement up to and including 1.5 GHz.

Figure 3:
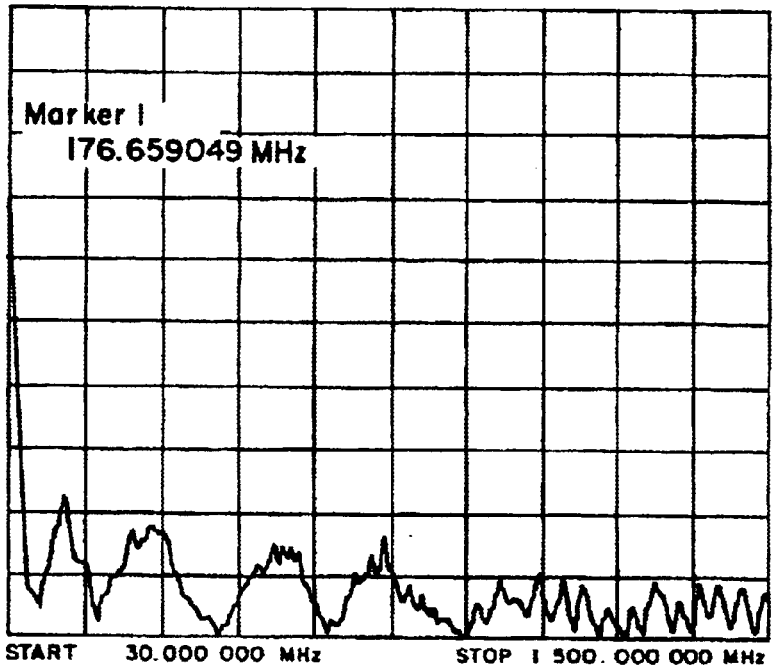
FIG. 3 is a graph of VSWR for the combined Vivaldi/MLA ultra wideband antenna, illustrating a VSWR less than 3:1.

As can be seen from FIG. 3, the VSWR of a combined Vivaldi/MLA ultra wideband antenna is less than 3:1 from a low frequency of 30 MHz up to a high frequency of 1.5 GHz.

Figure 4:
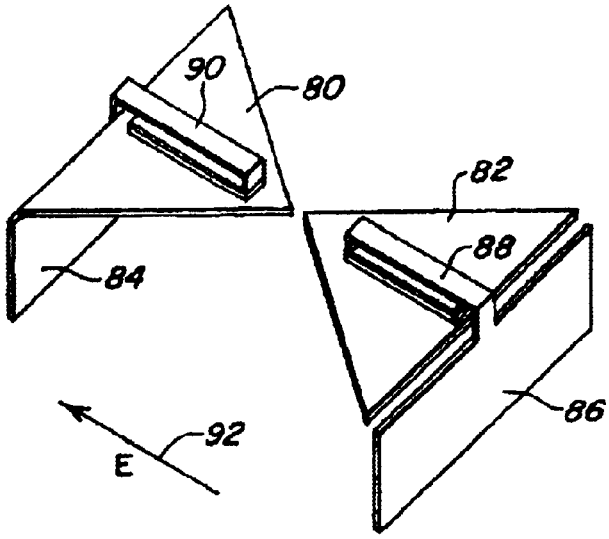
Fig. 4 (Prior Art)
FIG. 4 is a diagrammatic illustration of a prior art meander line loaded antenna illustrating triangular shaped top plates connected to side plates via a meander line.

From a theoretical point of view, and referring now to FIG. 4, a meander line loaded antenna in the past has been comprised of two triangular plates 80 and 82 and two corresponding side plates 84 and 86, joined to the top plates by meander lines 88 and 90. The E-field is noted by arrow 92.

As described in the afore-mentioned patent application, this structure has achieved a 10:1 bandwidth and can be made to have a low frequency cut-off as low as 30 MHz.

Figure 5:
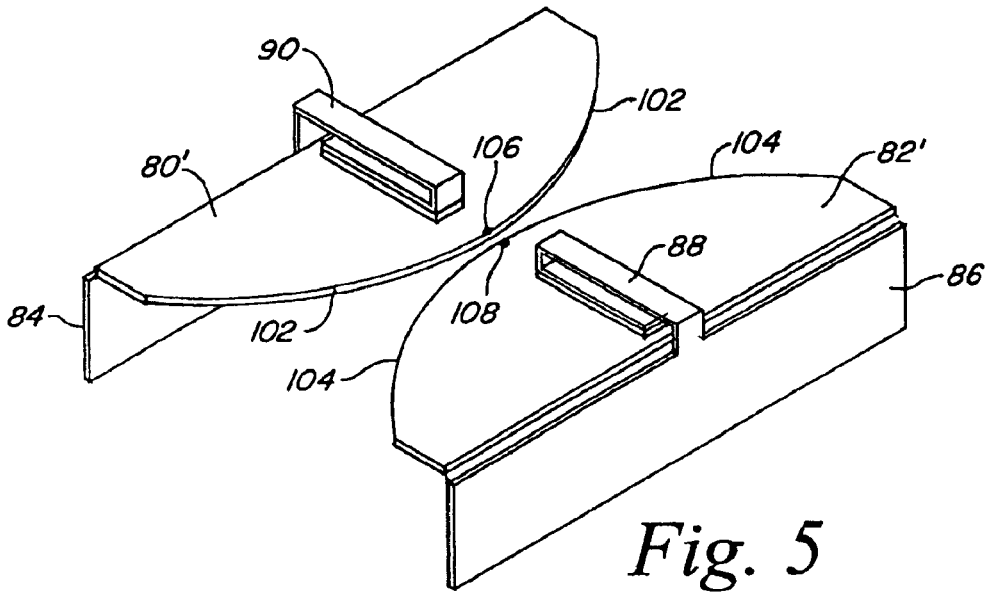
FIG. 5 is a diagrammatic illustration of the reconfiguring of the top plates of the meander line loaded antenna of FIG.

In considering how to design a combined Vivaldi notch and meander line loaded antenna structure, and referring now to FIG. 5, top plates 80' and 82' are configured with edges 102 and 104 which have the Vivaldi notch structure, namely that the edges have an exponential curve. In this case, meander lines 88 and 90 are the same as those shown in FIG. 4, with the feed points 106 and 108 being closest approximation of the two curves 102 and 104.

This type of antenna structure has an ultra wideband characteristic that rather than being unidirectional, is bidirectional. While this antenna is useful for some bidirectional purposes, in order to achieve the end firing unidirectional single lobe of that described in accordance with FIG. 2, the rearward portion of the Vivaldi notch is eliminated in favor of slot 46 of FIG. 2, with the antenna of FIG. 5 being provided the cavity of 44 of FIG. 2 to generate the end firing characteristic desired.

In this manner, the meander line loaded antenna of FIG. 4 is combined with the Vivaldi notch antenna of FIG. 1 so as to arrive at the configuration shown in FIG. 2 which delivers a single lobe forwardly firing ultra wide bandwidth antenna.

Having now described a few embodiments of the invention, and some modifications and variations thereto, it should be apparent to those skilled in the art that the foregoing is merely illustrative and not limiting, having been presented by the way of example only. Numerous modifi-cations and other embodiments are within the scope of one of ordinary skill in the art and are contemplated as falling within the scope of the invention as limited only by the appended claims and equivalents thereto.

What is claimed is:

1. An ultra wideband antenna comprising:

a combined Vivaldi notch antenna and a meander line loaded antenna, said Vivaldi notch antenna dominating for a high frequency range of said antenna and said meander line loaded antenna dominating for a continuous low frequency range of said antenna, the change over between high and low frequencies being smooth and without discontinuities.

2. The antenna of claim 1, wherein said antenna includes a top plate having a Vivaldi notch at one end thereof, said Vivaldi notch having a throat, a cavity behind said throat, a slot behind said cavity, and side plates to either side of said top plate, said side plates each including a meander line for coupling the side plate to a portion of said top plate to a side of said slot.

3. The antenna of claim 2, wherein the physical size of said antenna is minimized by said meander lines, thus to permit arraying of said antennas without producing grating lobes.

4. The antenna of claim 3, wherein the width of said top plate is less than 0.5 wavelengths at the highest frequency at which said antenna is to operate.

5. The antenna of claim 2, wherein said meander lines are coupled to exterior surfaces of said plates.

6. The antenna of claim 1, wherein said antenna is linearly polarized.

7. A method of extending the operating frequency range of a Vivaldi notch antenna, coupling the steps of:

providing the Vivaldi notch antenna with a rearwardly extending slot from the throat thereof, and providing a meander line loaded antenna having at least one side plate coupled to said Vivaldi notch antenna by the meander line thereof, whereby a combined Vivaldi notch and meander line loaded antenna is formed with the Vivaldi notch extending the high frequency cut-off of the antenna and with the meander line loaded antenna extending the low frequency cut-off of this antenna, thus to provide an ultra wide bandwidth antenna.

8. The method of claim 7, and further including the step of providing a cavity between the throat of the Vivaldi notch and the slot, thus to provide an end fire antenna.

9. The method of claim 8, wherein the Vivaldi notch is provided in a plate having a width less than 0.5 wavelengths at the high frequency cut-off of the antenna, thus to preclude the generation of grating lobes when said antenna is arrayed with other Vivaldi notch/meander line loaded antennas.

* * * * *